US007114998B2

(12) United States Patent
Ishikawa et al.

(10) Patent No.: US 7,114,998 B2
(45) Date of Patent: Oct. 3, 2006

(54) DIVIDED CONNECTOR AND CONNECTOR ASSEMBLY

(75) Inventors: Ryotaro Ishikawa, Yokkaichi (JP); Hajime Kawase, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/044,907

(22) Filed: Jan. 27, 2005

(65) Prior Publication Data

US 2005/0170704 A1 Aug. 4, 2005

(30) Foreign Application Priority Data

Feb. 2, 2004 (JP) ..... 2004-025556

(51) Int. Cl.
*H01R 13/514* (2006.01)

(52) U.S. Cl. ..... 439/752

(58) Field of Classification Search ..... 439/752, 439/701, 489, 924.2, 680, 607–610
See application file for complete search history.

(56) References Cited

U.S. PATENT DOCUMENTS 5,913,703 A 6/1999 Suzuki et al.
6,193,563 B1 * 2/2001 Yagi et al. ..... 439/701
6,332,788 B1 * 12/2001 Okabe et al. ..... 439/157
6,592,398 B1 * 7/2003 Kashiyama et al. ..... 439/489
2002/0106942 A1 8/2002 Sakurai et al.

FOREIGN PATENT DOCUMENTS

JP 5-182716 7/1993

* cited by examiner

*Primary Examiner*—J. F. Duverne
(74) *Attorney, Agent, or Firm*—Casella & Hespos; Anthony J. Casella

(57) ABSTRACT

A housing main body (20) is connectable with a mating male connector (M) and internally formed with an accommodating chamber (22) into which an auxiliary housing (30) can be accommodated. The housing main body (20) is formed with cavities (23) for accommodating female terminal fittings (40) electrically connectable with mating male terminal fittings (11), and the respective cavities (23) are arranged at positions symmetrical with respect to an axis of symmetry (L1). A lock arm (50) is disposed on the axis of symmetry (L1) of the respective cavities (23). The housing main body (20) is integrally formed with the lock arm (50) capable of holding the male connector (M) connected by the engagement with an engaging portion (16) of the male connector (M).

10 Claims, 12 Drawing Sheets

DIVIDED CONNECTOR AND CONNECTOR ASSEMBLY

BACKGROUND OF THE INVENTION

1. Field of the Invention

The invention relates to a divided connector.

2. Description of the Related Art

Japanese Unexamined Patent Publication No. H05-182716 and FIG. 12 herein disclose a divided connector. With reference to FIG. 12, the divided connector has a housing main body 1 and auxiliary housings 2 are accommodated in chambers 3 of the housing main body 1. The divided connector is connectable with a mating connector 4 by operating a lever 5 mounted on the housing main body 1. The lever 5 can be locked to keep the connector mated with the mating connector 4.

The lever 5 is U-shaped and crosses over the housing main body 1. Thus, the divided connector has tended to be large.

The invention was developed in view of the above problem and an object thereof is to miniaturize a divided connector.

SUMMARY OF THE INVENTION

The invention relates to a divided connector with a housing main body that is connectable with a mating connector. The housing main body has at least one accommodating chamber and at least one auxiliary housing is accommodated in the accommodating chamber. A lock arm is formed integrally or unitarily in the housing main body for engaging the mating connector and holding the mating connector connected.

The mating connector can be connected with the housing main body after the auxiliary housing is accommodated into the accommodating chamber of the housing main body. The lock arm formed in the housing main body then can be engaged with the mating connector to hold the mating connector connected. Accordingly, the divided connector can be smaller than a prior art divided connector with a U-shaped lever mounted on a housing main body.

The housing main body preferably has cavities for accommodating terminal fittings that are connectable with mating terminals in the mating connector. The cavities preferably are at substantially symmetrical positions in the housing main body.

The auxiliary housing may be used without being accommodated into the accommodating chamber. Frictional resistance between the terminal fittings and the mating fittings will not be skewed in this case because the cavities are arranged symmetrically in the housing main body. Therefore, connecting operability can be better.

The lock arm preferably is substantially on an axis of symmetry of the cavities in the housing main body. Thus, a frictional resistance between the lock arm and the mating connector during the connection of the two connectors will not be skewed, and connecting operability can be better.

The accommodating chambers preferably are at substantially symmetrical positions in the housing main body.

The auxiliary housing preferably is substantially symmetric with respect to an auxiliary housing axis of symmetry.

An axis of symmetry of the cavities and the auxiliary housing axis of symmetry preferably are substantially parallel, and preferably overlap.

The auxiliary housing preferably comprises cavities arranged at substantially symmetrical positions in the auxiliary housing.

A protecting portion preferably is provided to surround and protect the lock arm.

The invention also relates to a divided connector assembly comprising the above described divided connector and a mating connector connectable therewith.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A preferred embodiment of a connector assembly according to the invention is illustrated in FIGS. 1 to 10. The connector assembly has a divided female connector F connectable along a connecting direction CD with a mating male connector M. In the following description, sides of the connectors F, M to be connected together are referred to as the front, and reference is made to the drawings excluding FIGS. 3, 4, 9 and 10 concerning the vertical direction.

Figure 6:
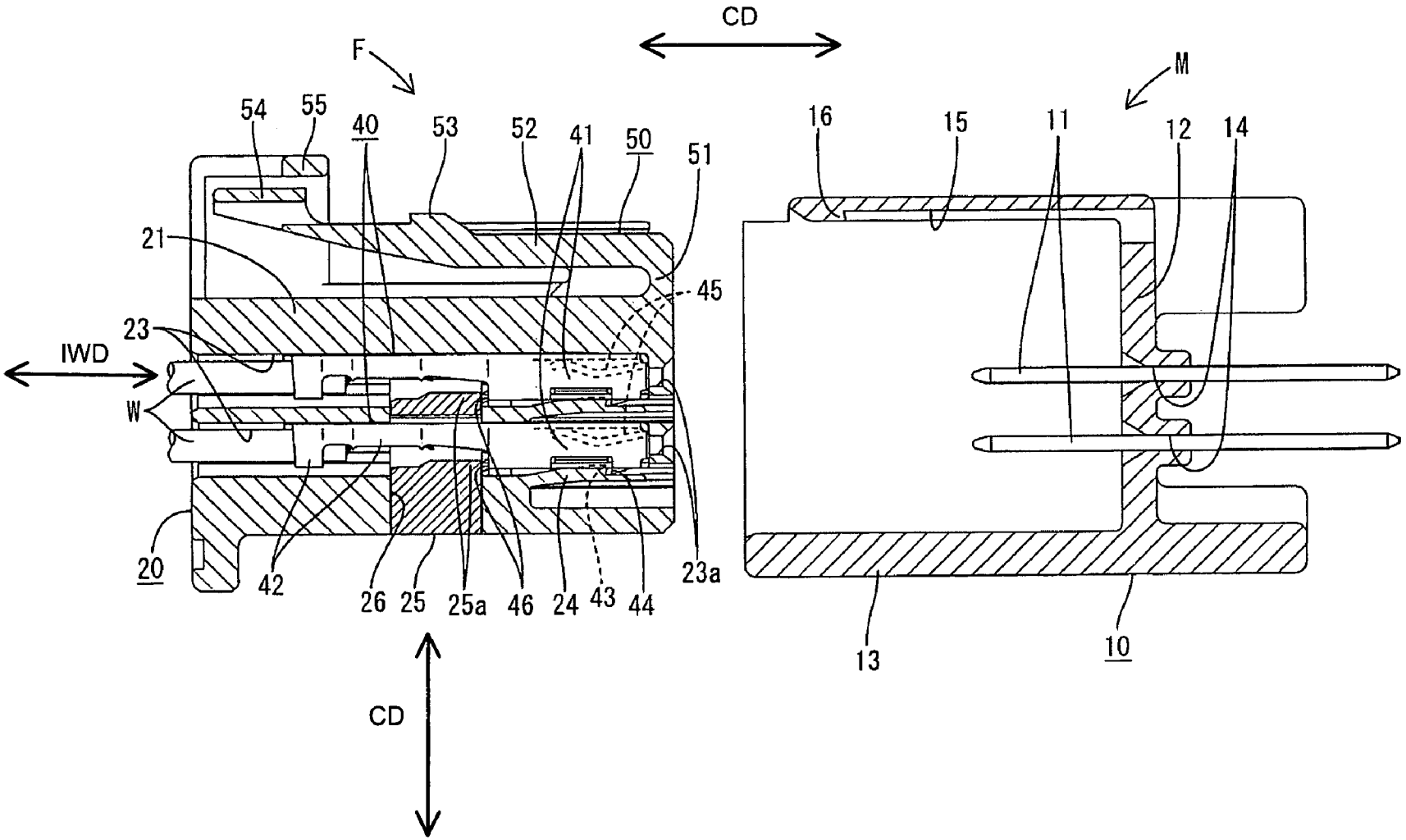
FIG. 6 is a section along 6—6 of FIG. 1 showing a state before two connectors are connected.

As shown in FIG. 6, the male connector M has a male housing 10 made e.g. of a synthetic resin. Male terminal fittings 11 are held in a terminal accommodating portion 12 of the male housing 10 and a receptacle 13 projects forward from the outer peripheral edge of the terminal accommodating portion 12. The receptacle 13 is a substantially rectangular tube with an open front end, and the female connector F is fittable into the receptacle 13 from the front. Twenty terminal insertion holes 14 are formed substantially side by side along a width direction at each of upper and lower stages in the terminal accommodating portion 12. The male terminal fittings 11 are inserted respectively into the terminal insertion holes 14. Each male terminal fitting 11 has a tab that extends forward into the receptacle 13 for electrical connection with a female terminal fitting 40. A groove 15 is formed in the ceiling surface of the receptacle 13. The groove 15 has an open rear end and a closed front end, and an engaging portion 16 is provided before the groove 15. The engaging portion 16 has a front surface that slopes up and a rear locking surface that extends substantially normal to the connecting direction CD.

Figure 5:
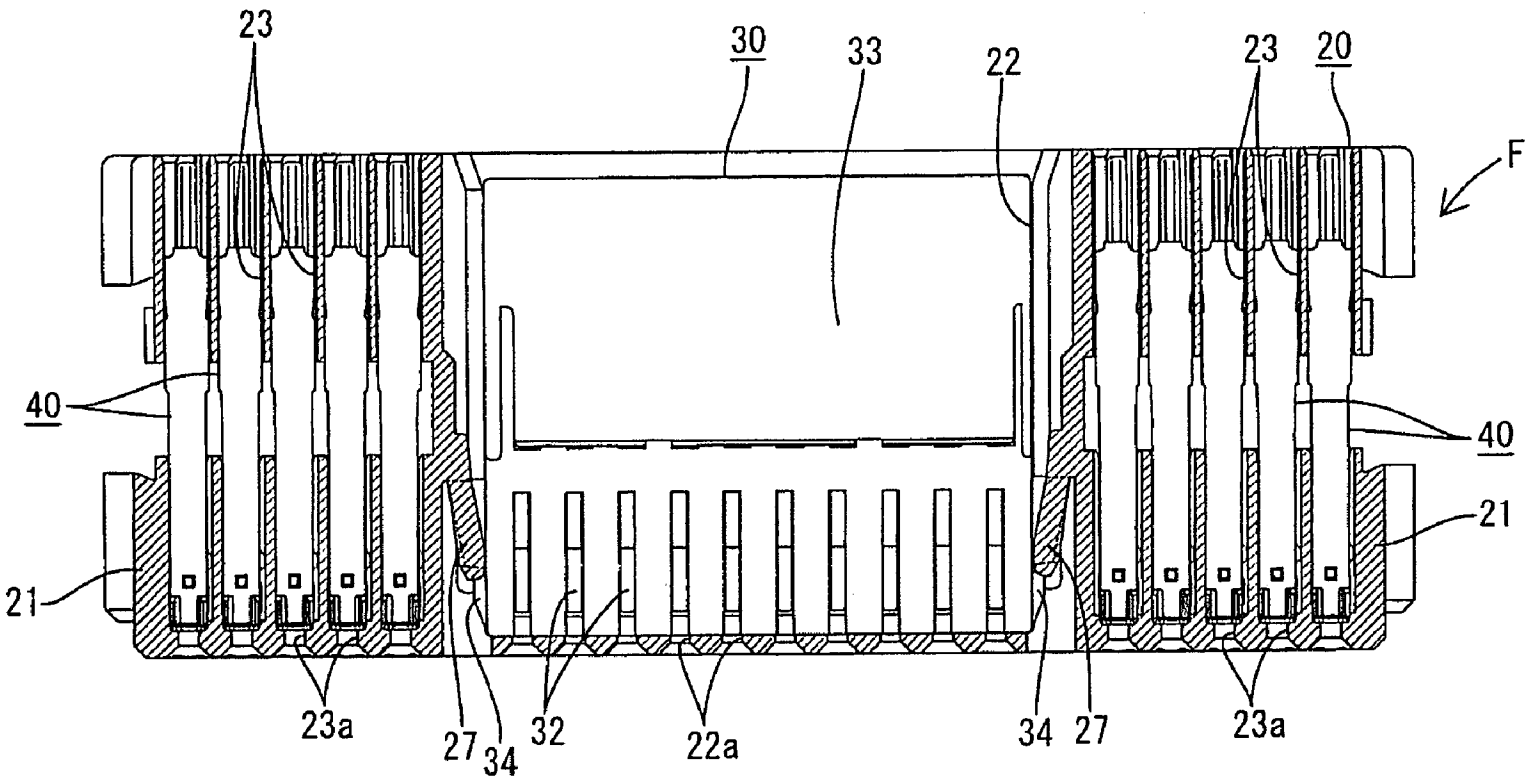
FIG. 5 is a section similar to FIG. 4, but showing a state where the auxiliary housing is assembled into the housing main body.

As shown in FIGS. 5 and 6, the female connector F has a housing main body 20 and auxiliary housings 30 that can be assembled into the housing main body 20. Female terminal fittings 40 are mountable into the housing main body 20 and/or the auxiliary housing 30. Each female terminal fitting 40 has a substantially box-shaped main portion 41 that is hollow in forward and backward directions. A barrel 42 is behind the main portion 41 and can be crimped, bent or folded into connection with an end of a wire W. A recess 43 is formed in an outer wall of the main portion 41, and the front edge of the recess 43 is embossed or bent to form a locking projection 44. A resilient contact piece 45 is provided in the main portion 41 for resiliently contacting the male terminal fitting 11.

Figure 1:
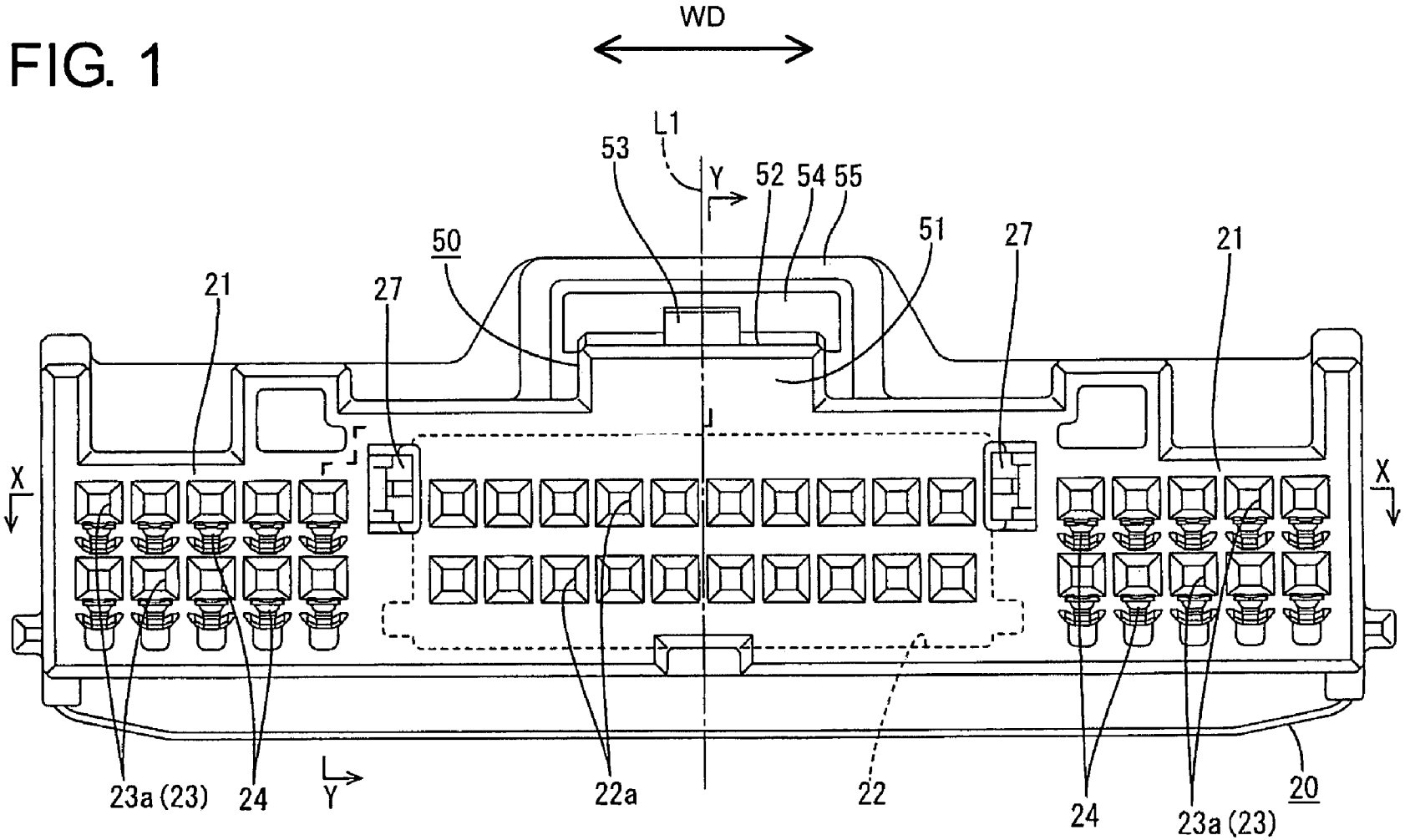
FIG. 1 is a front view of a housing main body of a female connector according to one embodiment of the present invention.
Figure 2:
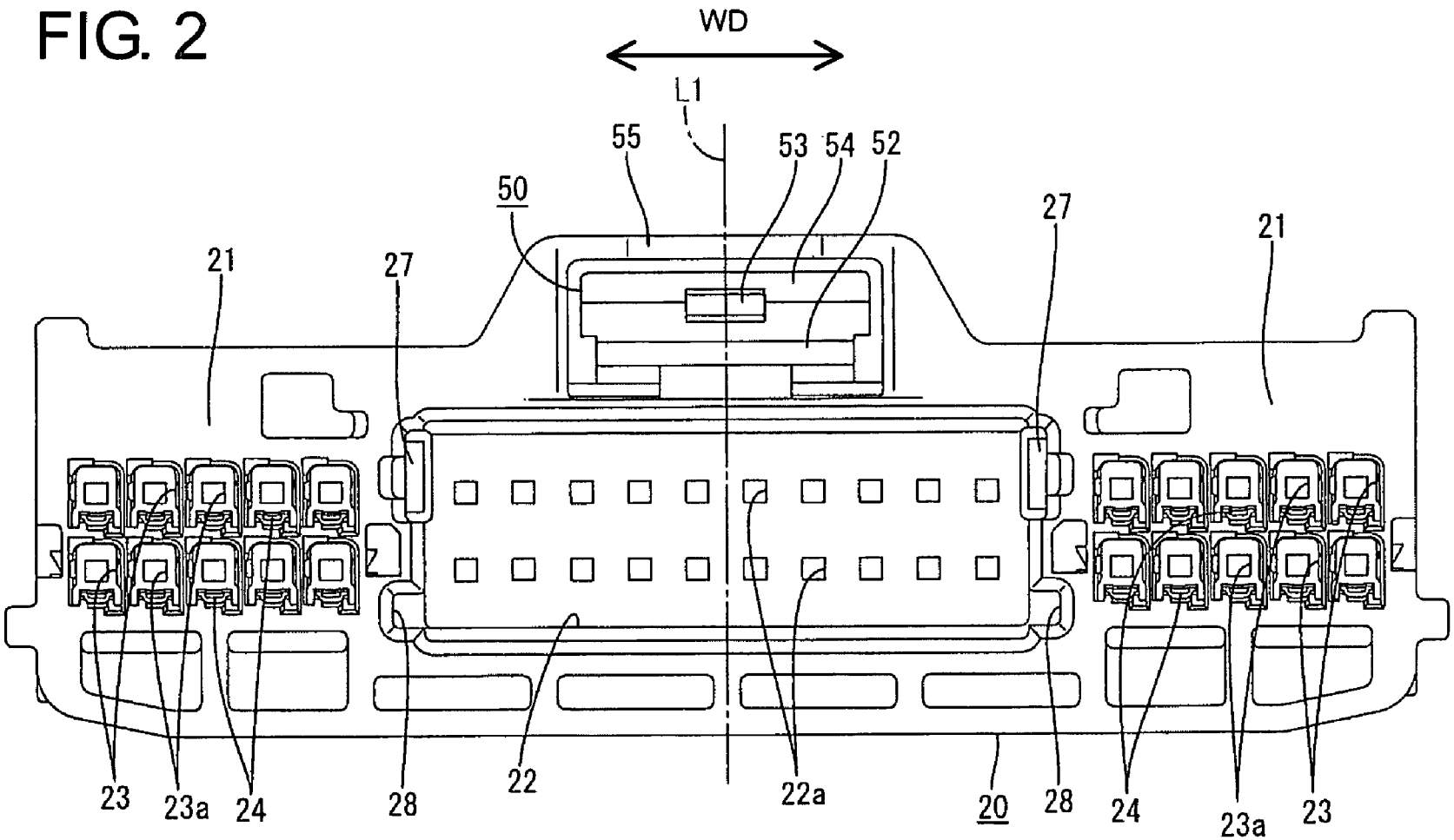
FIG. 2 is a rear view of the housing main body.

As shown in FIGS. 1 and 2, the housing main body 20 is made e.g. of a synthetic resin into a wide block shape that is substantially symmetrical about an axis of symmetry L1 extending normal to the width direction WD at the widthwise middle of the housing main body 20. Two terminal accommodating portions 21 are at opposite widthwise ends of the housing main body 20 to accommodate the female terminal fittings 40, and at least one accommodating chamber 22 is provided in a widthwise middle for accommodating the auxiliary housing 30. Five cavities 23 are formed side by side along the width direction WD at each of upper and lower stages in each terminal accommodating portion 21, and the female terminal fittings 40 are insertable into the cavities 23 from behind. The cavities 23 are arranged substantially symmetrically with respect to the axis of symmetry L1 in the housing main body 20. A lock 24 is provided in each cavity 23 for locking the female terminal fitting 40. As shown in FIG. 6, the lock 24 is supported at both ends and is formed by making slits in the bottom wall of each cavity 23. The lock 24 deforms during insertion of the female terminal fitting 40, but restores resiliently to engage the locking projection 44 of the female terminal fitting 40 when the female terminal fitting 40 reaches a proper depth. A terminal insertion hole 23*a* is formed in the front wall of each cavity 23 for receiving the male terminal fitting 11.

A retainer mount hole 26 is formed in the bottom surface of each terminal accommodating portion 21 for receiving a retainer 25 to lock the female terminal fittings 40 redundantly. The retainer 25 has locking sections 25*a* engageable with jaws 46 at the rear ends of the main portions 41 of the female terminal fittings 40. The retainer 25 is movable vertically in movable directions MD substantially normal to inserting and withdrawing directions IWD of the female terminal fittings 40. The retainer 25 is movable between a partial locking position (not shown) where the locking sections 25*a* are retracted from the cavities 23 to permit insertion of the female terminal fittings 40 into the cavities 23 and a full locking position (see FIG. 6) where the locking sections 25*a* are in the corresponding cavities 23 to lock the female terminal fittings 40.

Figure 4:
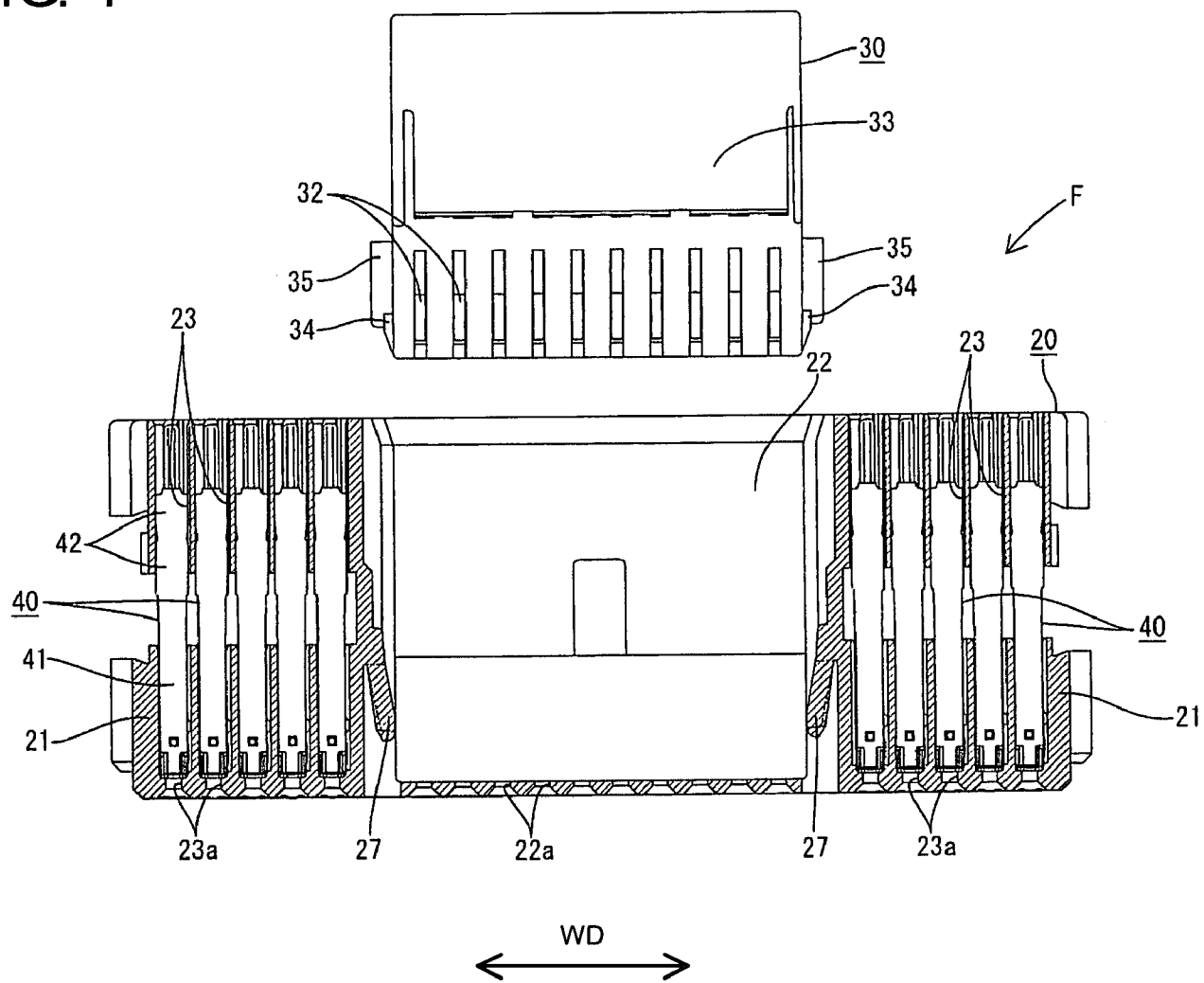
FIG. 4 is a section along 4—4 of FIG. 1 showing a state before the auxiliary housing is assembled into the housing main body.

As shown in FIGS. 2 and 4, the accommodating chamber 22 opens backward, and two holding pieces 27 are provided near the upper ends of the opposite inner side surfaces of the accommodating chamber 22 for holding the auxiliary housing 30. Each holding piece 27 is cantilevered from a rear end, and the free front end is engageable with the auxiliary housing 30. Two rearwardly open guiding grooves 28 are formed near the bottom ends of the opposite side surfaces of the accommodating chamber 22. Further, side by side terminal insertion holes 22*a* are formed substantially in the front wall of the accommodating chamber 22 at positions alignable with respective terminal insertion holes 31*a* of the auxiliary housing 30.

Figure 3:
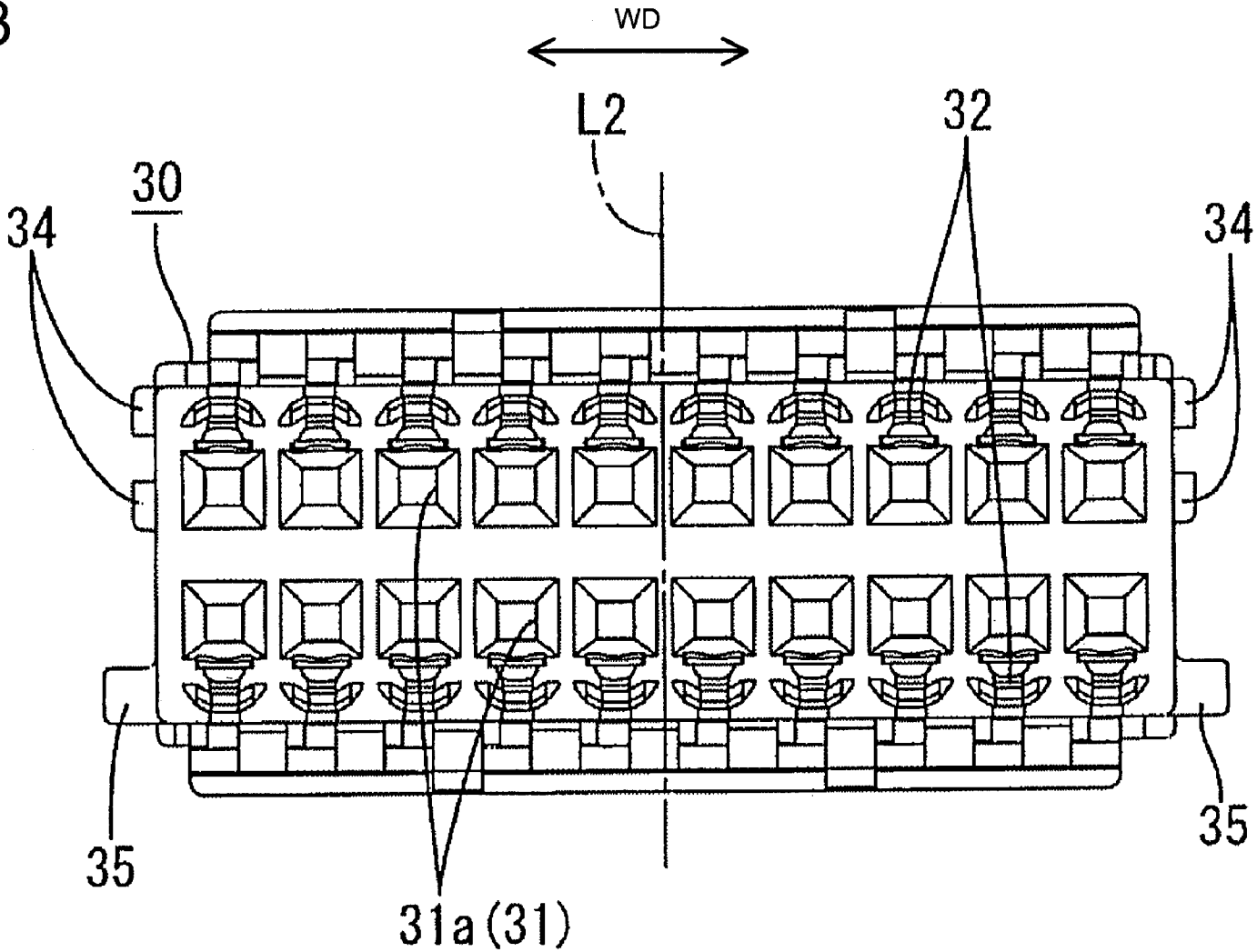
FIG. 3 is a front view of an auxiliary housing of the female connector.

The auxiliary housing 30 is made e.g. of a synthetic resin and is substantially in the form of a wide block. The auxiliary housing 30 is symmetrical with respect to an axis of symmetry L2 extending normal to the widthwise direction WD at the widthwise middle of the auxiliary housing 30, as shown in FIGS. 3 and 4. Ten cavities 31 are formed side by side along the width direction WD at upper and lower stages in the auxiliary housing 30 and are similar to the cavities of the housing main body 20. The cavities 31 are arranged substantially at the same heights as the cavities 23 of the housing main body 20. The respective cavities 31 are arranged at positions substantially symmetrical to the axis of symmetry L2 in the auxiliary housing 30. Each cavity 31 has a lock 32 and a terminal insertion hole 31*a* having functions similar to those of each cavity 23 of the housing main body 20. The locks 32 are formed in the outer walls of the auxiliary housing 30. Two retaining pieces 33 are formed in the outer walls of the auxiliary housing 30 at positions behind the locks 32. The retaining pieces 33 are fixed at one side and are dimensioned to cross all the cavities 31, The retaining pieces 33 are engageable with the jaws 46 of the female terminal fittings 40 similar to the retainer 25 (not shown).

Holdable portions 34 are provided on opposite outer side surfaces of the auxiliary housing 30 at the opposite widthwise ends for engaging the holding pieces 27 of the accommodating chamber 22. The holdable portions 34 project sideways from each side and include one at the upper end of the auxiliary housing 30 and one that is slightly lower. Two ribs 35 are provided at the bottom ends of the opposite side surfaces of the auxiliary housing 30, and function, for example, to guide an assembling operation of the auxiliary housing 30 by entering the guiding grooves 28 of the accommodating chamber 22.

As shown in FIGS. 1 and 6, a lock arm 50 is provided at a widthwise middle position of the upper surface of the housing main body 20 and at substantially the same position as the accommodating chamber 22 along the width direction WD. The lock arm 50 holds the mating male connector M connected. The lock arm 50 is substantially on the axis of symmetry L1 of the cavities 23 of the housing main body 20. The lock arm 50 is cantilevered from a base end 51 that projects from the front end of the upper surface of the housing main body 20 and a beam 52 extends substantially horizontally back parallel to the connecting direction CD from the base end 51. The beam 52 is resiliently deformable along vertical direction with the base end 51 as a support. A lock 53 projects up at a substantially longitudinal middle position of the upper surface of the beam 52 and is engageable with the engaging portion 16 of the male connector M. The front surface of the lock 53 slopes up and back to extend substantially parallel to the engaging portion 16, whereas the rear surface extends substantially normal to the connecting direction CD and parallel to the rear surface of the engaging portion 16. An operable portion 54 projects from the rear end of the beam 52 and is pressable from above. A substantially gate-shaped protecting portion 55 projects from the rear end of the upper surface of the housing main body 20. The protecting portion 55 surrounds at least part of the rear end of the lock arm 50 including at least part of the operable portion 54 from outside to prevent, for example, an external wire from entering between the beam 52 and the housing main body 20. As a result, upward deformation of the lock arm 50 can be prevented.

The female terminal fittings 40 are inserted along the inserting and withdrawal direction IWD into the cavities 23 of the housing main body 20 and are locked by the locks 24 and the retainers 25. The auxiliary housing 30 having the female terminal fittings 40 inserted into the cavities 31 is assembled into the accommodating chamber 22. The ribs 35 will not align with the guiding grooves 28 if the auxiliary housing 30 is inverted from a proper posture and will contact the rear end of the housing main body 20 to prevent insertion of the auxiliary housing 30 (see FIGS. 2 and 3).

The ribs 35 of the properly oriented auxiliary housing 30 enter the guiding grooves 28, as shown in FIG. 4, to guide the inserting operation. The holding pieces 27 move onto the holdable portions 34 and are deformed temporarily when the auxiliary housing 30 reaches a specified depth. The holdable portions 34 are before the holding pieces 27 when the auxiliary housing 30 is inserted to a substantially proper depth. Thus, the holding pieces 27 are restored resiliently and the front ends of the holding pieces 27 engage the rear end surfaces of the holdable portions 34, as shown in FIG. 5. In this way, the auxiliary housing 30 is held in the housing main body 20.

Figure 7:
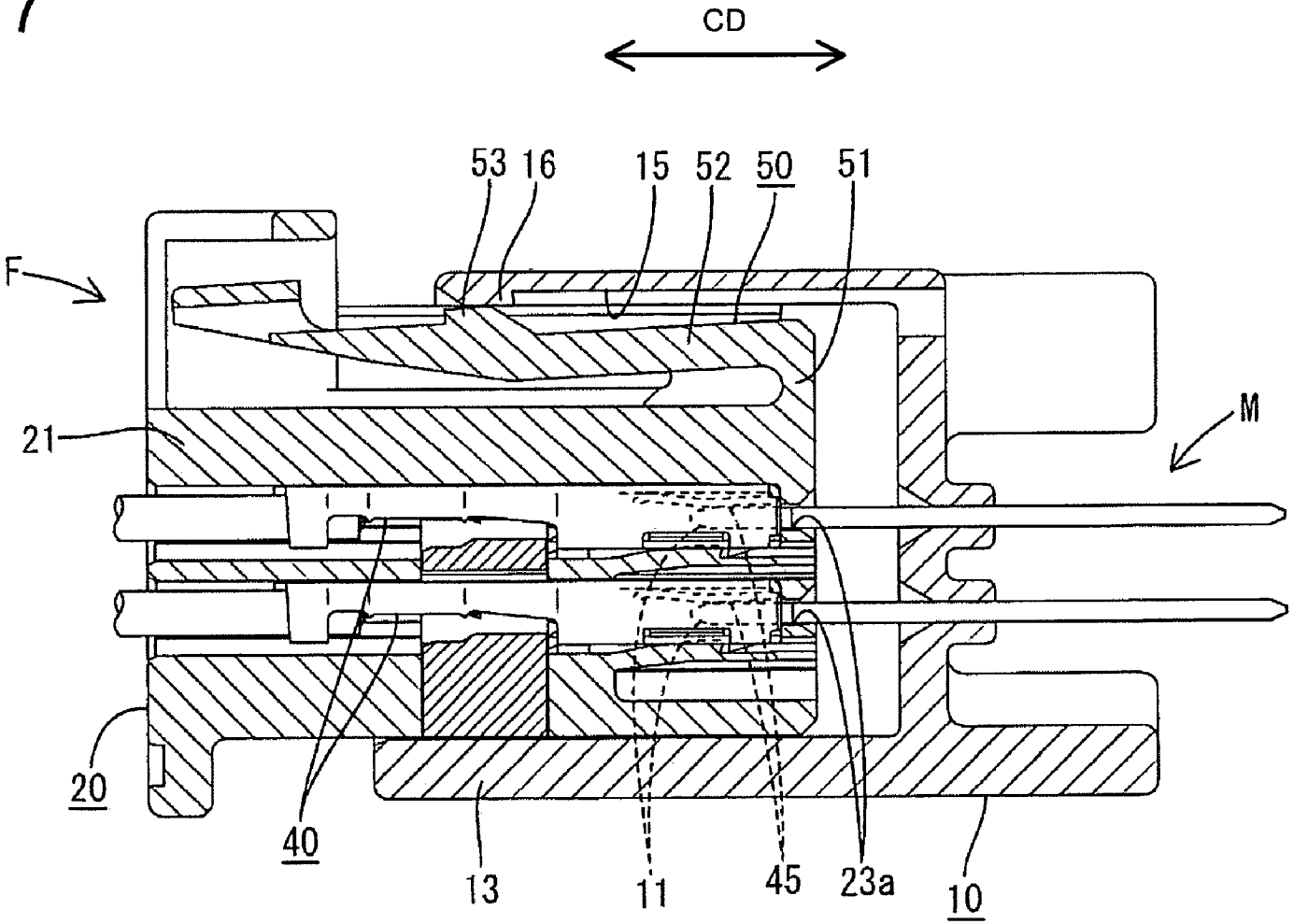
FIG. 7 is a section similar to FIG. 6, but showing an intermediate state of the connection of the two connectors.
Figure 8:
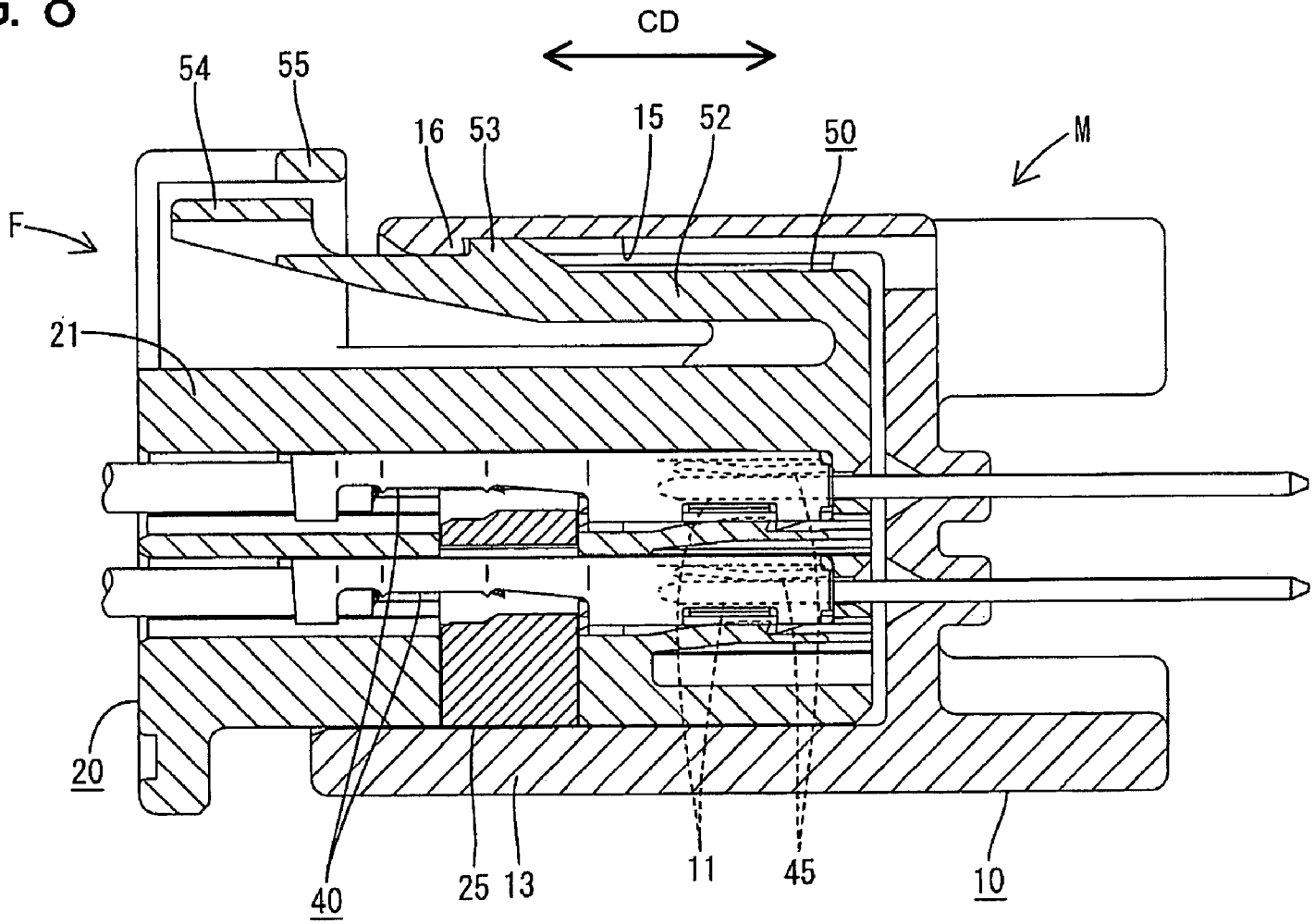
FIG. 8 is a section similar to FIG. 6, but showing a state where the two connectors are properly connected.

The assembled female connector F is connected with the male connector M along the connecting direction CD. Thus, the housing main body 20 is fit into the receptacle 13 of the male housing 10 from the front. Accordingly, the male terminal fittings 11 enter the respective cavities 23, 31 through the terminal insertion holes 22*a*, 23*a*, 31*a*. The slanted front surface of the lock 53 of the lock arm 50 and the slanted front surface of the engaging portion 16 slide in contact when the connection progresses further. As a result, the lock arm 50 deforms and the respective male terminal fittings 11 enter the main portions 41 to contact the resilient contact pieces 45, as shown in FIG. 7. At this time, the beam 52 of the lock arm 50 is inclined down towards the housing main body 20 with the base end 51 as a support. Frictional resistance is created due to the sliding contact of the male terminal fittings 11 with the resilient contact pieces 45 and the sliding contact of the lock 53 with the engaging portion 16. The lock arm 50 restores resiliently when the connectors F, M are connected to a proper depth to bring the lock 53 into the groove 15. Thus, the rear surface of the lock 53 engages the rear of the engaging portion 16 and the resilient contact pieces 45 contact the male terminal fittings 11, as shown in FIG. 8. In this way, the two connectors F, M are held connected.

Figure 9:
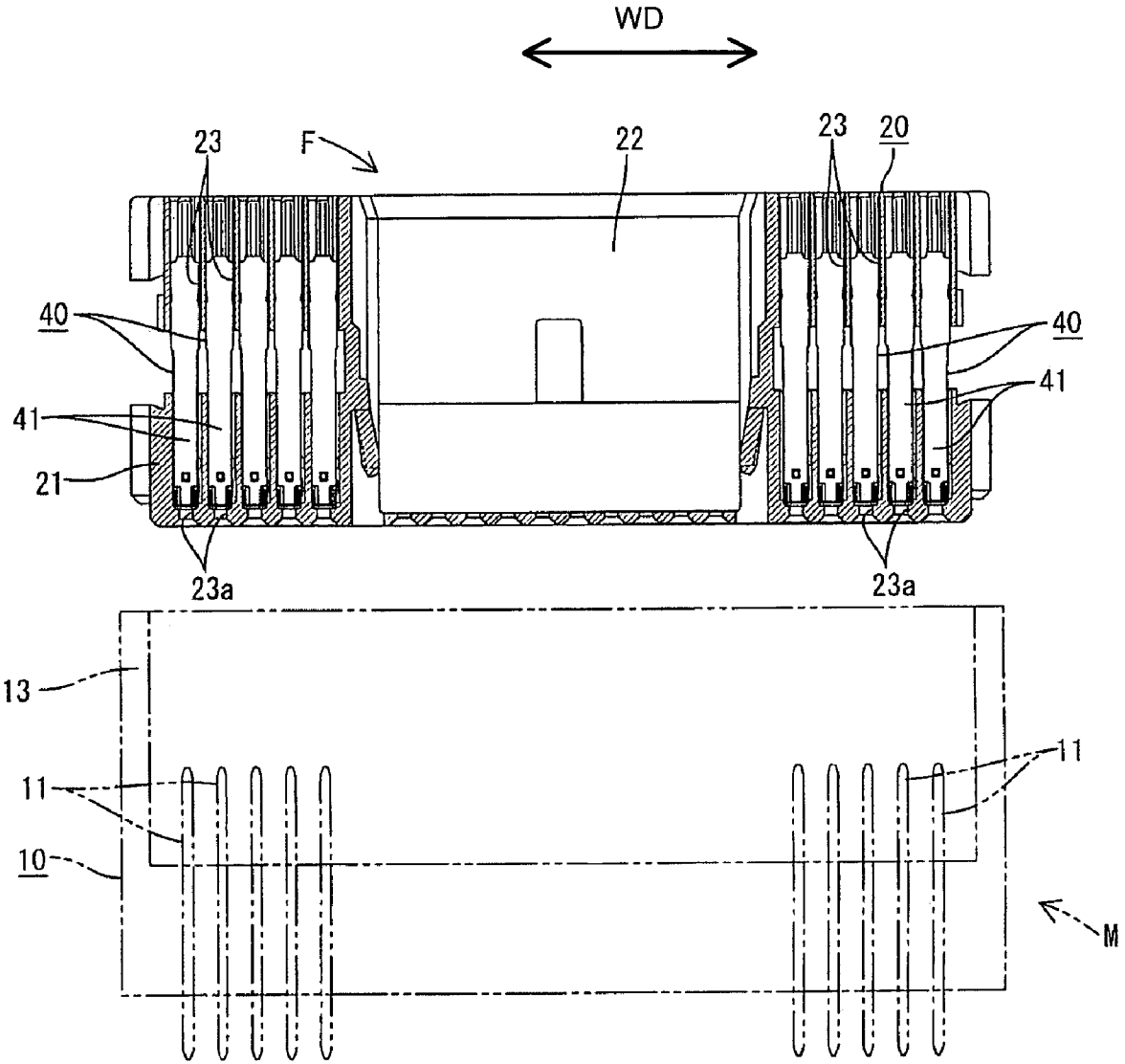
FIG. 9 is a section similar to FIG. 4, but showing a state before the housing main body with the auxiliary housing detached is connected with the male connector.
Figure 10:
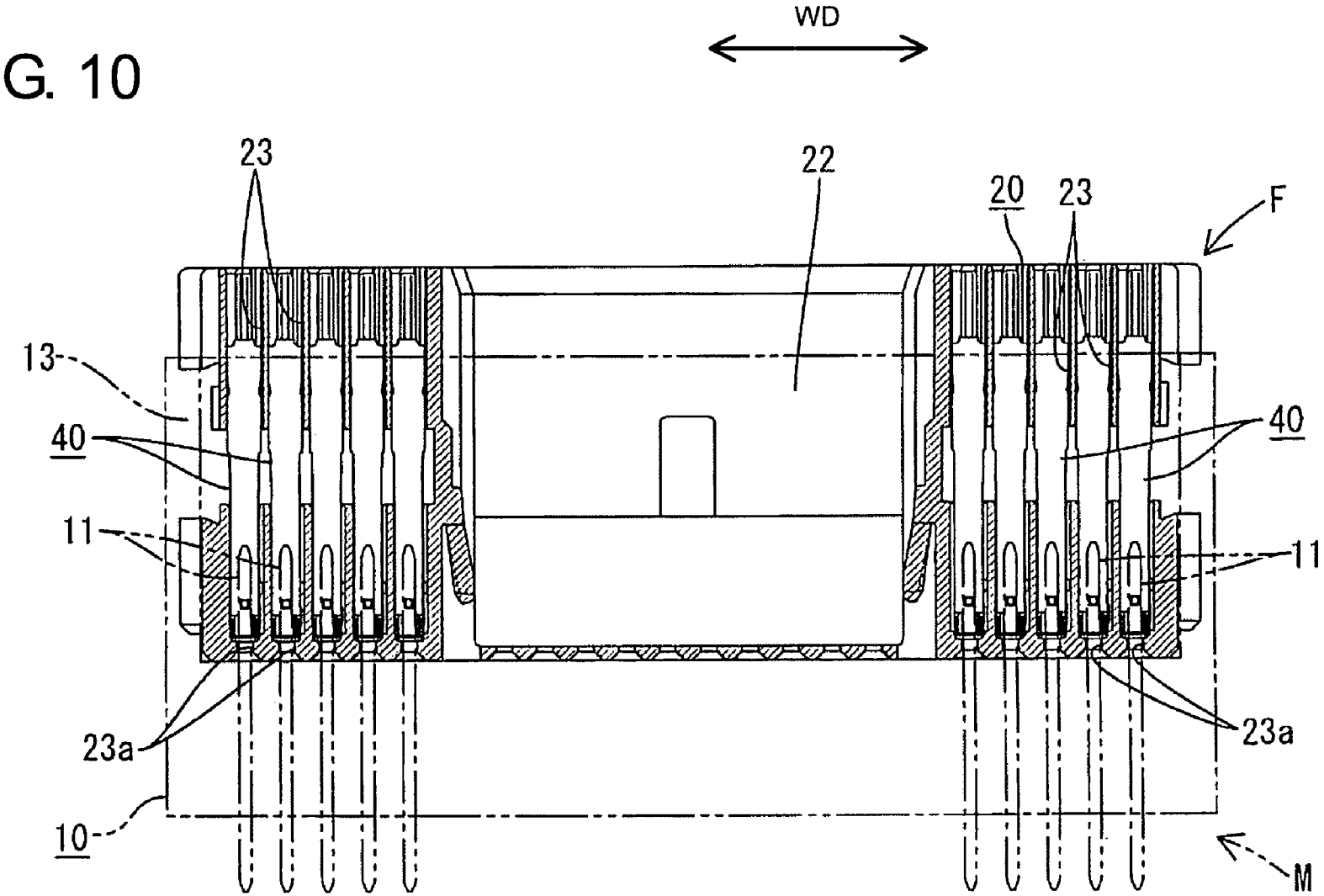
FIG. 10 is a section similar to FIG. 4, but showing a state where the housing main body with the auxiliary housing detached is connected with the male connector.

The auxiliary housing 30 may not be assembled into the housing main body 20 in certain instances. In such a case, as shown in FIGS. 9 and 10, the female connector F and the male connector M are connected with the accommodating chamber 22 empty or with a dummy housing inserted. However, the female terminal fittings 40 are inserted into the cavities 23 of the housing main body 20. Even in this condition, frictional resistance between the female terminal fittings 40 and the male terminal fittings 11 will not be skewed transversely since the cavities 23 are arranged symmetrically with respect to the axis of symmetry L1 in the housing main body 20. Further, the lock arm 50 is substantially on the axis of symmetry L1 of the cavities 23 in the housing main body 20. Thus, a frictional resistance force between the lock arm 50 and the engaging portion 16 during the connection of the two connectors F, M will not be skewed transversely. Therefore, connecting operability can be better.

As described above, the lock arm 50 is formed unitarily in the housing main body 20 that has the accommodating chamber 22 for receiving the auxiliary housing 30. Thus, the female connector F can be made smaller as compared to a prior art connector in which a U-shaped lever is mounted on a housing main body.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Figure 11:
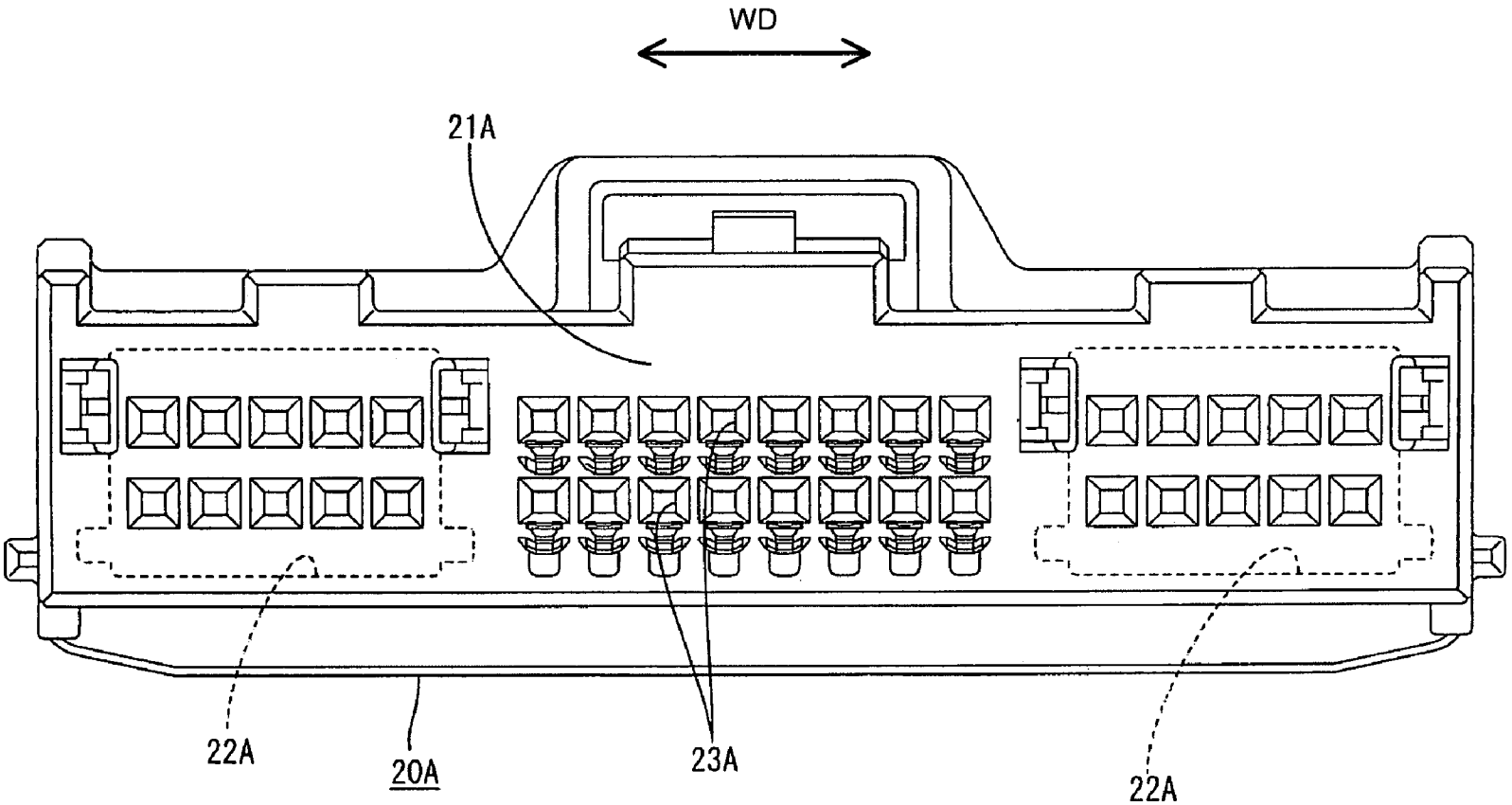
FIG. 11 is a front view of a housing main body according to another embodiment.
Figure 12:
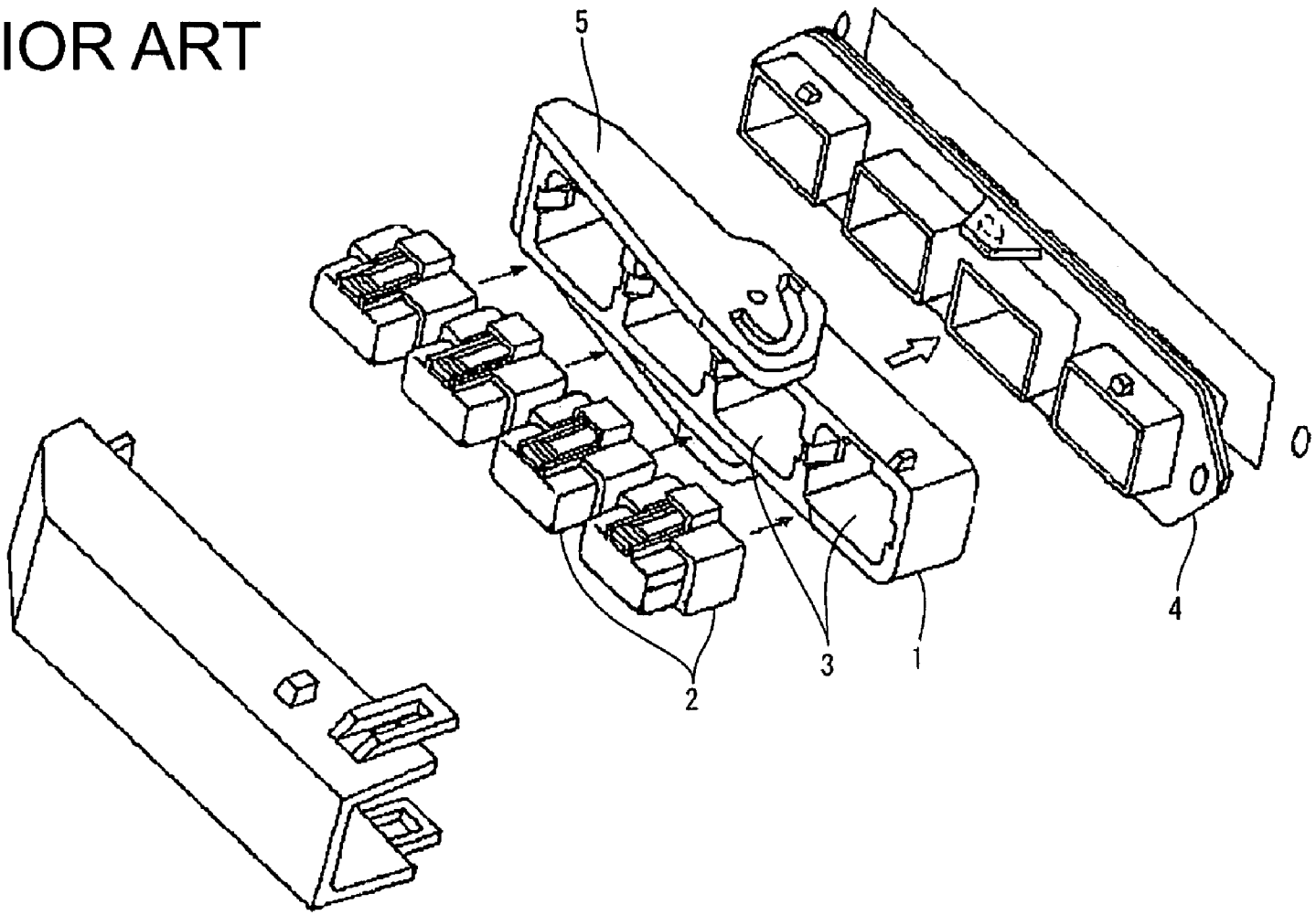
FIG. 12 PRIOR ART
FIG. 12 is a perspective view of a prior art divided connector.

The arrangements and the numbers of the cavities and the auxiliary housing in the housing main body can be changed. For example, as shown in FIG. 11, two accommodating chambers 22A are arranged symmetrically at opposite widthwise sides of a housing main body 20A for accommodating auxiliary housings (not shown) formed with five cavities juxtaposed along width direction WD at upper and lower stages. One terminal accommodating portion 21A is provided in a widthwise middle part with ten cavities juxtaposed along widthwise direction WD at each of upper and lower stages. It does not, of course, matter if three or more auxiliary housings are assembled. Further, it is not necessary to arrange the cavities perfectly symmetrically in the housing main body, and the cavities may be arranged at positions slightly displaced from the symmetrical ones.

The shapes of the housing main body and the auxiliary housing can be changed. For example, the housing main body and the auxiliary housing may be vertically long or substantially square according to the invention.

The position of the lock arm in the housing main body can be changed.

The housing main body may not be formed with the cavities (although being formed with the accommodating chamber) according to the invention.

The invention is also applicable to male divided connectors.

What is claimed is:

1. A divided connector, comprising:

a housing main body connectable with a mating connector, the housing main body being formed with cavities for accommodating terminal fittings connectable with mating terminals in the mating connector, the cavities being arranged at substantially symmetrical positions in the housing main body, at least one accommodating chamber formed in the housing main body at a substantially symmetrical position in the housing main body;

at least one auxiliary housing configured for accommodation in the accommodating chamber; the auxiliary housing comprising a plurality of cavities arranged at substantially symmetrical positions in the auxiliary housing, the auxiliary housing being substantially symmetric with respect to an auxiliary housing axis of symmetry that is substantially coincident with an axis of symmetry of the respective cavities in the housing main body; and a lock arm unitarily formed in the housing main body for holding the mating connector connected by being engaged with the mating connector, the lock arm being disposed on the axis of symmetry of the cavities in the housing main body.

2. The divided connector of claim 1, wherein a protecting portion at least partly surrounds the lock arm.

3. A divided connector assembly comprising the divided connector of claim 1 and a mating connector connectable therewith.

4. The divided connector of claim 1, wherein the cavities formed in the housing main body comprise a first array cavities and a second array of cavities, the accommodating chamber being formed in the housing main body between the first and second array of cavities.

5. The divided connector of claim 4, further comprising first and second retainers mountable in the housing main body at positions substantially aligned with the first and second arrays of cavities, the retainers being configured for locking the terminal fittings in their respective cavities of the housing main body.

6. The divided connector of claim 5, wherein the auxiliary housing comprises at least one retaining piece communicating with the respective cavities of the auxiliary housing for locking auxiliary terminal fittings in the auxiliary housing.

7. The divided connector of claim 6, wherein the lock is aligned substantially symmetrically with the accommodating chamber.

8. The divided connector of claim 1, wherein the at least one accommodating chamber comprises first and second accommodating chambers disposed symmetrically on opposite respective sides of the cavities in the housing main body, the at least one auxiliary housing comprising first and second substantially identical auxiliary housings configured for accommodation in the respective first and second accommodating chambers.

9. The divided connector of claim 8, wherein the lock is aligned substantially symmetrically with the cavities in the housing main body.

10. The divided connector of claim 1, wherein the accommodating chamber has a front wall for substantially abutting a front end of the auxiliary housing.

* * * * *